United States Patent [19]

Horinouchi et al.

[11] 3,940,539

[45] Feb. 24, 1976

[54] PRESSURE-SENSITIVE RECORDING SHEET

[75] Inventors: Tsukasa Horinouchi, Chigasaki; Setsuya Egawa; Masahiro Sakamoto, both of Kanagawa, all of Japan

[73] Assignee: NCR Corporation, Dayton, Ohio

[22] Filed: June 6, 1974

[21] Appl. No.: 477,122

[30] Foreign Application Priority Data

Oct. 31, 1973 Japan ..... 48-121832

[52] U.S. Cl. ..... 428/323; 427/149; 427/150; 428/325; 428/914

[51] Int. Cl.[2] ..... B41M 5/02; B41M 5/12

[58] Field of Search ..... 117/36.8, 36.2, 36.1, 36.9; 428/323, 914; 427/149, 150

[56] References Cited

UNITED STATES PATENTS

| | | | |
|---|---|---|---|
| 3,576,660 | 4/1971 | Bayless et al. | 117/36.8 |
| 3,617,334 | 11/1971 | Brockett et al. | 117/36.1 |
| 3,663,256 | 5/1972 | Miller et al. | 117/36.2 |
| 3,672,935 | 6/1972 | Miller et al. | 117/36.8 |
| 3,681,390 | 8/1972 | Lin | 117/36.2 X |
| 3,738,857 | 6/1973 | Brockett et al. | 117/36.1 |

*Primary Examiner*—Thomas J. Herbert, Jr.
*Attorney, Agent, or Firm*—Robert J. Shafer; E. Frank McKinney

[57] ABSTRACT

A pressure-sensitive sheet recording system is disclosed in which the components of the system are arranged and related so that the system is particularly resistant to smudge and accidental marking due to incidental contacting forces.

16 Claims, No Drawings

PRESSURE-SENSITIVE RECORDING SHEET

BACKGROUND OF THE INVENTION

1. Field of the Invention

The present invention relates to a pressure-sensitive sheet recording system. It more particularly relates to a pressure-sensitive recording system in which formation of smudge is prevented. "Smudge", as used herein, means the undesired colored product of reaction between a colorless, color-forming, material contained in microcapsules and a polymeric color-developing material, wherein the smudge is a result of incidental or accidental microcapsule rupturing contact. Smudge resistance is accomplished, in the present invention, by careful selection of solvents and careful arrangement of component materials.

2. Description of the Prior Art

U.S. Pat. No. 3,576,660 issued Apr. 27, 1971 discloses a smudge-resistant, pressure-sensitive sheet wherein there is an encapsulated, acid-reactive, chromogenic material in liquid solution and an encapsulated acid reactant in liquid solution. The two liquid solutions are contained in different kinds of capsules and are coated together onto sheet substrates. Smudge resistance is achieved, in that patent disclosure, by taking advantage of the different component releasing character of the two kinds of capsule walls.

U.S. Pat. No. 3,617,334 issued Nov. 2, 1971 discloses a smudge-resistant, pressure-sensitive sheet of a coating of encapsulated, acid-reactive, chromogenic material in liquid solution. The sheet is to be used with another surface containing the acid reactant. Smudge resistance is achieved, in that patent disclosure, by providing capsules which contain only diluent solvent in addition to the microcapsules containing chromogenic dye material. The diluent-containing capsules are provided in larger size than those containing dye; and the diluent-containing capsules are said to protrude above the dye-containing capsules in any capsule coating. Incidental, normally-smudge-producing, forces tend to contact only the larger capsules and be buffered away from the smaller capsules. The diluent capsules are solely for pressure buffering purposes and have contents-selected to have no effect on the color-producing components of the sheet.

U.S. Pat. No. 3,738,857 issued June 12, 1973 discloses a smudge-resistant, pressure-sensitive sheet wherein there are, both, encapsulated chromogenic material and encapsulated diluent material. The chromogenic material and the diluent material are encapsulated as individual, finely-divided, droplets aggregated together to yield a capsule unit of both kinds of materials separated, but present in the same capsules. The droplets of diluent are provided in larger size than droplets of the chromogen; and the diluent droplets serve as force buffers in much the same way as discussed in the previous paragraph.

SUMMARY OF THE INVENTION

Generally, a pressure-sensitive sheet recording system is based on the color-forming reaction of a colorless electron-donating color-forming material such as Crystal Violet Lactone (CVL) or Benzoyl Leucomethylene Blue (BLMB) with an electron-accepting developing material comprising clay minerals, such as activated clay and bentonite, or polymeric materials, such as phenol-aldehyde polymer, phenolacetylene polymer and maleic acid resin. From viewpoint of structure, a pressure-sensitive recording system is constructed from one sheet onto which both the microcapsules containing color-forming material and the color-developing material are applied or two sheets of which one has a layer of the microcapsules and the other has a layer of the color-developing material.

In the usual types of pressure-sensitive recording systems, features of the systems which provide for prevention of smudge (hereinafter sometimes called color-pollution) before use, detract from excellence of color-forming potential at the time of use;--satisfaction of one feature forcing sacrifice of the other. For example, in a pressure-sensitive recording system constructed from one sheet carrying a layer of microcapsules containing color-forming material or agent and another sheet carrying a layer of color-developing material or agent which is devoted to actual use by placing the transfer sheet (the microcapsule sheet) on the take-up sheet (the developing sheet), a solvent having a low viscosity, good transfer property and strong affinity to the developing agent is desirable from the viewpoint of obtaining an intense color. However, such solvent is undesirable from the viewpoint of preventing smudge caused by accidental pressure unavoidably applied to the sheet prior to its intended use. A few techniques have so far been proposed for the purpose of overcoming such disadvantages; they are, for example, a technique to control the hardness of capsule wall, wall thickness and capsule size, the use of different kinds of capsule wall materials, and a technique for preventing fracture of microcapsules prior to use by adding cellulose fiber, glass beads or starch granules to the liquid slurry of microcapsules to be applied to the sheet. However, none of the techniques has been completely successful.

The color-pollution is caused by unavoidable pressure exerted under conditions of winding, cutting, printing, overlapping, storing and transporting the sheets, and is characterized by the fact that the fracture of microcapsules does not take place over the whole pressed area but that the capsules more susceptible to fracture, such as those having smaller thickness of wall, lower hardness of wall or greater capsule size, are ruptured first of all. It follows that the usual type of pressure-sensitive recording sheets, in which a solvent with good transfer property, low viscosity and strong affinity to color-developing material is used for dissolving the color-forming material and in which the encapsulated solution, once a capsule has been ruptured, immediately reacts with the color-developing material, quite frequently suffer color-pollution.

In light of the above-mentioned facts, it is an object of the present invention to provide a pressure-sensitive sheet recording system in which the color-pollution is effectively prevented without sacrificing the high potential of color development. In the present invention, the color-forming material is dissolved in a solvent having only a weak affinity to the polymeric color-developing material and then is encapsulated. Furthermore, in the invention, apart from the microcapsule containing the solution of color-forming material, there is another microcapsule containing only a solvent having strong affinity to the color-developing material. If necessary, the latter microcapsule may contain additionally a polymeric substance. Thus, in the invention the color-forming material is isolated from the only solvent which is suitable as the medium of color-forming reaction. Accordingly, the invention is applicable to all types of pressure-sensitive recording sheets. The invention is applicable to the two-sheet type of recording manifold in which a multitude of microcapsules containing a color-forming agent are applied to the back side of a transfer sheet and a developing agent, encapsulated or not, is applied to the front side of a take-up sheet, as well as the three-sheet and multi-sheet types of manifold in which one or plural middle sheets are inserted between the transfer and the take-up sheets, the middle sheet having a layer of developing agent on its front side and a layer of encapsulated color-forming agent on its back side. In these cases, the microcapsule containing the solvent of high affinity to developing agent may be incorporated either in the layer with the developing agent or in the layer with the color-forming agent so long as all of the components are contiguously located in the recording system.

If the single-sheet type is desired, a multitude of capsules containing color-forming agent, a multitude of capsules containing the solvent of strong affinity to the developing agent and the developing agent, either encapsulated or not, are blended together to give a homogeneous mixture and then applied to a surface of a single sheet. This type of single sheet can be placed one on another repeatedly until the desired number of sheets have been assembled into a manifold set having any number of contiguous surfaces. The system components can all be located on the same surface, thus, establishing a requirement that the system of this invention must have at least one surface.

In another embodiment of the invention, a polymeric material is dissolved into a solvent having a strong affinity to the said polymer and then encapsulated. Combination of the obtained microcapsule with another microcapsule containing color-forming agent permits a very ready preparation of pressure-sensitive recording sheet.

In this invention, the solvent having weak affinity to the color-developing material and used for the purpose of dissolving the color-forming agent is selected from the group comprising, for example, castor oil, esters of trimellitic acid, chlorinated paraffin, esters of phthalic acid, diphenylether, diisopropylnaphthalene and hydrogenated terphenyl. Each of these solvents may be used by itself alone. If desired, however, it may be used in combination with one or more other members of the group. In a particularly effective embodiment, one of the above-mentioned solvents is mixed with a low-viscosity solvent having a relatively weak affinity to the developing agent. The viscosity of the resultant mixture is adjusted to a value somewhat higher than the viscosity of the solvent having strong affinity to developing agent, to be further discussed, below, which is encapsulated together with or not together with a polymeric material. The viscosity adjustment, while not necessary, permits the color-forming agent to flow out at a most satisfactory rate at the time of rupture of the microcapsules.

As the solvent having a strong affinity to the color-developing material and encapsulated together with or not together with a polymeric material, diarylmethane, diarylethane, monoisopropylnaphthalene, esters of maleic acid, triaryldimethane and lower-alkyl diphenyl, can be cited. Each of these solvents may be used by itself alone. If desired, however, each solvent may be used in combination with one or more members of the group. In a particularly effective embodiment, one of the group is combined with a low-viscosity solvent which will not interfere with the developing agent, so that the viscosity of the mixture is adjusted to a value lower than the solvent for the color-forming agent. The solvent having a strong affinity to the color-developing material must also be miscible with the solvent having a weak affinity for the color-forming material.

Eligible color-forming agents or materials other than the CVL and BLMB, above-mentioned, include any colorless, chromogenic dye-precursor materials such as those materials disclosed in U.S. Pat. No. 3,672,935 and U.S. Pat. No. 3,681,390.

Eligible color-developing agents or materials are polymers which include the preferred paraphenyl phenol polymer and other phenol-formaldehyde polymers such as those disclosed in U.S. Pat. No. 3,672,935 and U.S. Pat. No. 3,663,256.

Thus there are presented two kinds of microcapsules in the embodiments of the invention; one is that containing the color-forming material and the other is that containing the solvent. If the two kinds of microcapsules are simultaneously fractured under an unavoidable pressure before the final use of the recording sheet — namely, in the stages of winding, cutting, printing, piling, storing and transporting the product, a color-pollution will result. This pollution can be reduced by proper selection of capsule wall thicknesses and hardnesses and relative capsule sizes between the kinds of microcapsules.

If the pressure-sensitive recording sheet is submitted to a pressure before its intended use, those capsules to be fractured are not the total of the microcapsules located on the considered pressed area, but those capsules particularly weaker among them. Thus only one of the two kinds of microcapsules is fractured to release its content, which fracture causes no color-formation. This makes it possible to achieve prevention of color-pollution more significantly than in the case of usual pressure-sensitive recording sheets. For example, in the prior art pressure-sensitive recording sheet, if the microcapsule containing color-forming agent is fractured, an immediate formation of color-pollution is observed. In the case of the pressure-sensitive recording sheet of this invention, however, the solvent which flows out with color-forming agent has so weak an affinity to the color-developing agent that no color-pollution results.

Under conditions of final use, where a localized pressure is applied to the sheet by the use of pencil or typewriter, almost all of the microcapsules existing on the pressed area are fractured. As a consequence, the color-forming agent from one kind of capsule flows together with the solvent of strong affinity to the color-developing agent from the other kind of capsule. This enables intentional development of intense color on the area.

The following examples will further illustrate the invention.

EXAMPLE 1

A. Six grams of CVL and 4 grams of BLMB as colorless couplers are dissolved in 30 grams of castor oil as oil substance. The solution thus obtained is mixed with 60 grams of alkyl benzene as viscosity compensating oil and the entire liquid is emulsified in 85 grams of 10 percent, by weight, gelatin solution so that an oil-in-water emulsion is prepared having oil droplets about 3–4 microns in diameter.

Next, 85 grams of 10 percent, by weight, gum arabic solution and the aforementioned emulsion are mixed, and then combined with 200 grams of water at 55 degrees centigrade. Using 15 percent, by weight, acetic acid, the pH is lowered to 4.5 so that a coacervate can be formed and deposited about the oil droplets.

Then, after the system of capsules is cooled so that the coacervate part is gelled, it is cured with formalin in such a way that pH of the system is raised to 10.3 to react with the gelatin of the capsule walls and obtain microcapsules containing coupler having sufficient strength for practical use.

B. Seventy-five grams of diaryl ethane oil (such as the material sold under the trademark "Hisol SAS" by Nihon Petrochemical Co., Ltd.) is emulsified in 85 grams of 10 percent, by weight, gelatin solution until oil droplets are about 1–2 microns in diameter. The emulsion is mixed with gum arabic solution as indicated in (A), and by treating it in the same way as indicated above it is microencapsulated. Other oils which can be used in the capsules of this part (B) are ethyldiphenylmethane and dibenzylethylbenzene and combinations of those oils.

Amounts of each kind of microcapsules made in (A) and (B), above, are blended equally, based on capsule wall gelatin content. After it is coated on the back of an upper sheet and dried, a sharply coupled record is obtained, when writing pressure is applied thereto while laminating it with a lower sheet having a surface coating of paraphenyl phenol polymer. The coupled record has excellent light resistance, water resistance and coupled density; and, further, shows excellent smudge preventive properties.

As a test, when only microcapsules containing coupler (A) are coated on the back of upper sheet and when writing pressure is applied while laminating it on the aforementioned lower sheet, there is no indication of any coupling reaction.

The test demonstrates that unless there is use of a solvent having a strong affinity to paraphenyl phenol polymer (such as, in this example, diaryl ethane) the coupler does not react with the colorizing agent to form color.

EXAMPLE 2

A. The microcapsule containing color-forming agent is the same as that mentioned in the foregoing Example 1, part (A).

B. Finely powdered p-phenylphenol resin (such as the material sold under the commercial designation, "PP-810", by GUNEI-KAGAKU) is dispersed into 85 grams of 10 percent, by weight, gelatin solution using a homogenizer. The resulting suspension is combined with 85 grams of 10 percent, by weight, solution of gum arabic and then with 200 grams of water at 55 degrees centigrade. A treatment similar to that mentioned in Example 1 (A) results in a microcapsule containing finely powdered p-phenylphenol resin.

C. A microcapsule containing a solvent with strong affinity to developing agent, similar to that in Example 1 (B), is prepared.

The microcapsules from parts (A), (B) and (C) are mixed together in equal proportion based on capsule wall gelatin content. The mixture is substantially homogeneously distributed on the surface of a paper and dried to give a single-sheet type of recording sheet. Three of the sheets are placed one on another and writing pressure is applied to the top sheet. An intensely colored image develops on each of the sheets. The sheet is excellently prevented against formation of color-pollution and is characterized by its high color intensity after development.

EXAMPLE 3

A. Into 30 grams of trimellitic acid ester (such as the material sold under the trademark "Trimex", by KAO-SEKKEN), 6 grams of CVL and 4 grams of BLMB, as colorless color-forming agents, are dissolved. Viscosity of the solution is regulated by mixing it with 60 grams of kerosene to give an oily solution.

The oily solution is emulsified with 85 grams of 10 percent, by weight, gelatin solution to give an oil-in-water emulsion with an oil droplet diameter of 3–4 microns.

The emulsion is combined with 85 grams of 10 percent, by weight, solution of gum arabic followed by 200 grams of water at 55 degrees centigrade. After a thorough mixing, 15 percent, by weight, acetic acid is slowly added until pH of the mixture has reached 4.5 and coacervate is deposited around the oil droplets. The coacervate is gelled by reducing the temperature of the system and then is hardened with formalin at a pH of about 10.3. Thus, microcapsules with commercially satisfactory strength are obtained.

B. Ninety-five grams of triaryldimethane (such as the material sold under the trademark "MARUTHERM-S", by Orient Chemicals) is emulsified with 85 grams of 10 percent, by weight, gelatin solution to give an oil-in-water emulsion with an average oil droplet diameter of 1–2 microns. Treatments similar to Example 3 microcapsule product.

The microcapsule (A) and (B) are mixed together, as in previous examples, in the proportion to give an identical level of gelatin quantity. The mixture is applied onto a paper already coated by paraphenyl phenol polymer to give a singular type of recording sheet. When three of the sheets are placed one on another and writing pressure is applied, clear colored images develop on each sheet. The sheet exhibits excellent resistance to formation of color-pollution. As was taught in the three examples, above, smudge resistance in the present invention is increased by utilizing microcapsules containing the solvent with weak affinity for the color-developing material in droplets about 1 to 3 microns larger than the droplets in microcapsules containing solvent with strong affinity for the color-developing material.

What is claimed is:

1. A smudge-resistant pressure-sensitive sheet recording system having at least one surface and four components for producing a colored mark on application of pressure, comprising:

i. solid polymeric color-developing material located on a surface of the recording system;

ii. colorless, color-forming material reactive with (i) to yield a colored mark;

iii. liquid solvent including (ii) dissolved therein, having only a weak affinity for (i) and contained in a multitude of microcapsules located on a surface of the recording system;

iv. liquid solvent miscible with (iii), having a strong affinity for (i) and contained in a multitude of microcapsules located on a surface of the recording system;

the microcapsules containing (ii) and (iii) having droplets of liquid with an average diameter of about 1 to 3 microns greater than the average diameter of droplets in the microcapsules containing (iv) and;

the components being contiguously located in the recording system such that when a microcapsule containing (ii)) and (iii) is ruptured, released liquid contacting (i) nevertheless forms insignificant color due to lack of affinity of (iii) for (i) and when a microcapsule containing (iv) is ruptured, released liquid contacting (i) forms insignificant color because no (ii) is present and when microcapsules containing (i) and (iii) and microcapsules containing (iv) are ruptured, (ii), (iii), and (iv) combine and, on contact with (i), yield a colored mark.

2. The recording system of claim 1 wherein microcapsules containing (ii) and (iii) and microcapsules containing (iv) are located on the same surface.

3. The recording system of claim 2 wherein the microcapsules containing (ii) and (iii) and the microcapsules containing (iv) are substantially homogeneously distributed over the surface.

4. The recording system of claim 2 wherein microcapsules containing (ii) and (iii) and microcapsules containing (iv) are located on the same surface with (i).

5. The recording system of claim 2 wherein (i) is located on one surface of the system and microcapsules containing (ii) and (iii) and microcapsules containing (iv) are located on another, but contiguous, surface of the system.

6. The recording system of claim 1 wherein microcapsules containing (ii) and (iii) are located on one surface of the system and microcapsules containing (iv) are located on another, but contiguous, surface of the system.

7. The recording system of claim 1 wherein the viscosity of liquid in microcapsules containing (ii) and (iii) is higher than the viscosity of liquid in microcapsules containing (iv).

8. A smudge-resistant pressure-sensitive sheet recording system having at least one surface and four components for producing a colored mark on application of pressure, comprising:

i. solid polymeric color-developing material located on a surface of the recording system;

ii. colorless, color-forming material reactive with (i) to yield a colored mark;

iii. liquid solvent selected from the group consisting of castor oil, esters of trimellitic acid, chlorinated paraffin, esters of phthalic acid, diphenylether, diisopropylnaphthalene and hydrogenated terphenyl, including (ii) dissolved therein, having only a weak affinity for (i) and contained in a multitude of microcapsules located on a surface of the recording system;

iv. liquid solvent selected from the group consisting of diarylmethane, diarylethane, monoisopropylnaphthalene, esters of maleic acid, triaryldimethane and lower-alkyl diphenyl, miscible with (iii), having a strong affinity for (i) and contained in a multitude of microcapsules located on a surface of the recording system;

the components being contiguously located in the recording system such that when a microcapsule containing (ii) and (iii) is ruptured, released liquid contacting (i) nevertheless forms insignificant color due to lack of affinity of (iii) for (i) and when a microcapsule containing (iv) is ruptured, released liquid contacting (i) forms insignificant color because no (ii) is present and when microcapsules containing (ii) and (iii) and microcapsules containing (iv) are ruptured, (ii), (iii), and (iv) combine and, on contact with (i), yield a colored mark.

9. The recording system of claim 8 wherein microcapsules containing (ii) and (iii) and microcapsules containing (iv) are located on the same surface.

10. The recording system of claim 9 wherein the microcapsules containing (ii) and (iii) and the microcapsules containing (iv) are substantially homogeneously distributed over the surface.

11. The recording system of claim 9 wherein microcapsules containing (ii) and (iii) and microcapsules containing (iv) are located on the same surface with (i).

12. The recording system of claim 11 wherein (i) is contained in microcapsules.

13. The recording system of claim 9 wherein (i) is located on one surface of the system and microcapsules containing (ii) and (iii) and microcapsules containing (iv) are located on another, but contiguous, surface of the system.

14. The recording system of claim 8 wherein microcapsules containing (ii) and (iii) are located on one surface of the system and microcapsules containing (iv) are located on another, but contiguous, surface of the system.

15. The recording system of claim 8 wherein the microcapsules containing (ii) and (iii) have droplets of liquid with an average diameter of about 1 to 3 microns greater than the average diameter of droplets in the microcapsules containing (iv).

16. The recording system of claim 8 wherein the viscosity of liquid in microcapsules containing (ii) and (iii) is higher than the viscosity of liquid in microcapsules containing (iv).

* * * * *